US008215869B2

(12) United States Patent
VanBuskirk

(10) Patent No.: US 8,215,869 B2
(45) Date of Patent: Jul. 10, 2012

(54) REINFORCED SOIL ARCH

(75) Inventor: Calvin D. VanBuskirk, Salmon Arm (CA)

(73) Assignee: Terratech Consulting Ltd., Salmon Arm (CA)

( * ) Notice: Subject to any disclaimer, the term of this patent is extended or adjusted under 35 U.S.C. 154(b) by 238 days.

(21) Appl. No.: 12/509,991

(22) Filed: Jul. 27, 2009

(65) Prior Publication Data

US 2011/0020066 A1 Jan. 27, 2011

(51) Int. Cl.
*E02D 29/045* (2006.01)
*E02D 29/05* (2006.01)

(52) U.S. Cl. ..... 405/149; 405/125; 405/126; 405/153

(58) Field of Classification Search ..... 405/124, 405/125, 126, 146, 151, 153, 149, 302.7; 52/86, 88, 89
See application file for complete search history.

(56) References Cited

U.S. PATENT DOCUMENTS

| | | | | |
|---|---|---|---|---|
| 832,017 | A * | 9/1906 | Hummel | 405/126 |
| 1,028,638 | A * | 6/1912 | Thorsby | 405/124 |
| 1,926,843 | A * | 9/1933 | Fischer | 138/106 |
| 3,508,406 | A | 4/1970 | Fisher | |
| 4,010,617 | A | 3/1977 | Fisher | |
| 4,141,666 | A * | 2/1979 | DeGraff | 405/126 |
| 4,318,635 | A * | 3/1982 | Gurtner et al. | 405/126 |
| 4,605,338 | A | 8/1986 | Peterson | |
| 4,618,283 | A | 10/1986 | Hilfiker | |
| 5,720,577 | A * | 2/1998 | Sanders et al. | 405/124 |
| 6,050,746 | A | 4/2000 | McCavour et al. | |
| 6,874,974 | B2 | 4/2005 | VanBuskirk et al. | |
| D566,852 | S * | 4/2008 | Gaster et al. | D25/1 |

FOREIGN PATENT DOCUMENTS

| | | |
|---|---|---|
| CA | 1056169 | 6/1979 |
| CA | 1340179 | 12/1998 |
| CA | 2254595 | 6/1999 |

* cited by examiner

*Primary Examiner* — Tara Mayo-Pinnock
(74) *Attorney, Agent, or Firm* — Oyen Wiggs Green & Mutala LLP

(57) ABSTRACT

A reinforced soil arch having an archway form, a combination of alternating and interacting layers of compacted mineral soil and geosynthetic reinforcement material placed over and adjacent to the archway form, and a plurality of shear resisting devices secured to the exterior surface of the archway form. The shear resisting devices cause the archway form and the combination of alternating layers of compacted mineral soil and geosynthetic reinforcement material to act as an integral unit when static or dynamic loads are placed on the reinforced soil arch. Methods for constructing a reinforced soil arch are provided.

20 Claims, 4 Drawing Sheets

REINFORCED SOIL ARCH

FIELD OF THE INVENTION

This invention relates to a novel design of reinforced soil arches which can be used to construct bridges, overpasses, underpasses, snow sheds, landslide and rock fall protection structures, and the like. More particularly, this invention pertains to an innovative use of compacted mineral soil (clay, silt, sand, gravel, cobbles, boulders, broken rock or mixtures of any or all of the foregoing), geosynthetic reinforcement and an arch form to construct a versatile and environmentally compatible reinforced soil arch that can be used for numerous purposes.

BACKGROUND OF THE INVENTION

Bridges, culverts, overpasses, and the like, are traditionally constructed of expensive and environmentally incompatible steel structures, reinforced concrete structures, plastic structures and the like. For instance, bridges are usually constructed using concrete and/or steel foundations supporting pre-stressed concrete spans or suspended concrete and/or steel spans extending between the supports. Culverts used in road construction, often in stream beds, are usually constructed of concrete, corrugated steel or corrugated plastic pipes or pipe arches. Open bottom steel and concrete arch structures are usually constructed on concrete or steel footings. Installation of these footings is often a significant component of the cost of the arch installation and often involves excavation below the level of the stream bed. This can result in damage to the stream and introduction of sediment to the stream or result in costly mitigation techniques to prevent or limit the extent of damage and sedimentation. Snowsheds and avalanche sheds used in highway and railway construction are usually constructed as concrete and/or steel bridge-like structures, often in the form of a box or arch. Such structures must be designed to accommodate large, unbalanced loads. Otherwise these rigid structures can topple and/or collapse.

A problem with concrete, corrugated metal culverts and corrugated plastic culverts is that with freeze/thaw cycles, water erosion and dynamic vehicle loads on the culverts, the soil compacted around the concrete, steel or plastic culverts can become loose and erode away, thereby leaving an uneven load distribution on the culvert. When this occurs, the uneven load distribution may be sufficient to cause the culvert to collapse. The undermining of footings supporting steel, concrete or plastic arches can result in the loss of support for the soil compacted around the arch. This can result in uneven loading on the structure and possible collapse of the structure. Then it may be necessary to close the road or railway for a period of time while the structure is repaired or replaced.

U.S. Pat. No. 6,874,974 B1, granted Apr. 5, 2005, VanBuskirk et al., discloses a novel design of reinforced soil arches which can be used to construct bridges, overpasses, snowsheds, landslide or rock fall protection structures, and the like. In particular, the patent discloses an innovative use of compacted mineral soil (clay, silt, sand, gravel, cobbles, boulders, broken rock or mixtures of any or all of the foregoing) in combination with geosynthetic reinforcement to construct a reinforced soil arch that can be used for numerous purposes. The patent also discloses a method for constructing the reinforced soil arch comprising constructing an arch utilizing a combination of layers of compacted mineral soil and reinforcement in a manner that supports both the dead load of the structure and a live load imposed on the structure. Mechanisms for securing the reinforcement and the other components together are also disclosed.

The following patents also disclose subject matter that is more or less relevant to the subject invention:

U.S. Pat. No. 4,618,283, Hilfiker, Oct. 21, 1986

U.S. Pat. No. 6,050,746, McCavour et al., Apr. 18, 2000

Canadian Patent No. 1,056,169, Fisher, Jun. 12, 1979

Canadian Patent No. 1,340,179, Kennedy et al., Nov. 23, 1988

Canadian Application No. 2,254,595, McCavour et al., filed Nov. 27, 1998

SUMMARY OF INVENTION

This invention relates to an innovative and improved design of reinforced soil arches. More particularly, the invention pertains to an innovative use of layers of compacted mineral soil (clay, silt, sand, gravel, cobbles, boulders, broken rock or mixtures of any or all of the preceding) and alternating layers of geosynthetic reinforcement constructed on a curved arch form such as steel to provide a reinforced soil arch. The invention uses alternating layers of compacted soil and reinforcement consisting of geosynthetics, plastic, metal and/or the like, constructed in the form of an arch that supports both the dead load of the structure and the live load imposed on the structure. In one embodiment, the construction of the reinforced soil arch involves the use of a basic arch shaped form, either of constant or varying curvature, to aid in construction of the soil arch, to provide confinement for the compacted soil, and to prevent raveling of the soil following construction. The arch-shaped form is used for the purpose of constructing the soil arch and is not a major load carrying component of the structure. The major load, both dynamic and static, is borne by the combination of the alternating layers of geosynthetic reinforcement and the compacted soil, which overlie the arch-shaped form. The arch-shaped form may consist of metal, concrete, reinforced concrete, wood, plastic or reinforced plastic. The form is not limited to a shallow curve or circular curve arch shape and may consist of a reentrant arch, vertical or horizontal ellipse, pear or box-shaped or curved overpass/underpass structure.

An important feature of the invention is its unique simplicity, economy, and ease of construction. No permanent footing is required to support the structure. Installation of permanent footings can be very disruptive to the environment. However, in some situations, it may be necessary to place the form on either a temporary or an elastic footing such as a metal base plate to facilitate construction and long-term performance. The footing does not require embedment (burial). This allows for the crossing of environmentally sensitive areas (such as streams) without significant excavation into the sensitive areas.

The invention is directed to a method of constructing a self-supporting reinforced soil arch comprising: (a) placing on the ground of the location where the soil arch is to be erected an archway form, said exterior surface of said archway form having disposed thereon a plurality of shear resisting devices; (b) erecting over and adjacent to the archway form a series of alternating and interacting layers of compacted mineral soil and geosynthetic reinforcement material, the alternating layers of compacted mineral soil and geosynthetic reinforcement material interacting with the shear resisting devices on the top surface of the archway form to cause the reinforced soil arch to act as an integral unit in absorbing load forces placed on the soil arch.

The shear resisting devices on the exterior surface of the archway form can be a series of angle plates attached to the archway form. Base plates can be affixed to the respective bases of the archway form and retard the form from separating from the interface with the alternating layer of compacted mineral soil and reinforcement material.

The geosynthetic reinforcement material can consist of geosynthetic, plastic, metal or wood material. The geosynthetic reinforcement material can comprise woven geotextile.

The archway form can be in the shape of a constant or varying curvature arch, reentrant arch or box-shaped arch. The archway form can be in the form of a reentrant arch, a vertical or horizontal ellipse, a pear shape, a box shape or a curved overpass/underpass.

The invention is also directed to a self-supporting reinforced soil arch comprising: (a) an archway form which is placed on the location where the soil arch is to be erected; (b) a combination of alternating and interacting layers of compacted mineral soil and geosynthetic reinforcement material placed over and adjacent to the archway form; and (c) a plurality of shear resisting devices secured to the exterior surface of the archway form and interacting with the combination of alternating layers of compacted mineral soil and geosynthetic reinforcement material to thereby cause the archway form and the combination of alternating layers of compacted mineral soil and geosynthetic reinforcement material to act as an integral unit when static or dynamic loads are placed on the reinforced soil arch.

The reinforcement material can consist of geosynthetic, plastic, metal or wood. The geosynthetic reinforcement material can be woven geotextile. Respective base plates can be secured to the bases of the archway form and retard the alternating layers of compacted mineral soil and reinforcement material from subsiding and separating from the interface with the archway form. The archway form can be constructed of metal, concrete, plastic, wood or a composite of two or more of the above.

The shear resisting devices can be a series of angle plates welded or bolted to the top surface of the archway form. The reinforced soil arch can include base plates affixed to the respective bases of the archway form. The archway form can be a semicircle or a shallow semicircle, a reentrant arch, a vertical or horizontal ellipse, a pear shape, a box shape or a curved overpass/underpass.

The invention is also directed to a self-supporting reinforced soil arch comprising: (a) an archway form which is placed on the location where the soil arch is to be erected; (b) a combination of alternating and interacting layers of compacted mineral soil and geosynthetic reinforcement material placed over and adjacent to the archway form; (c) a plurality of angle plates secured to the exterior surface of the archway form and interacting with the combination of alternating layers of compacted mineral soil and geosynthetic reinforcement material to thereby cause the archway form and the combination of alternating layers of compacted mineral soil and geosynthetic reinforcement material to act as an integral unit when static or dynamic loads are placed on the reinforced soil arch; and (d) base plates affixed to the respective bases of the archway form.

BRIEF DESCRIPTION OF DRAWINGS

In drawings which illustrate specific embodiments of the invention, but which should not be construed as restricting the spirit or scope of the invention in any way.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
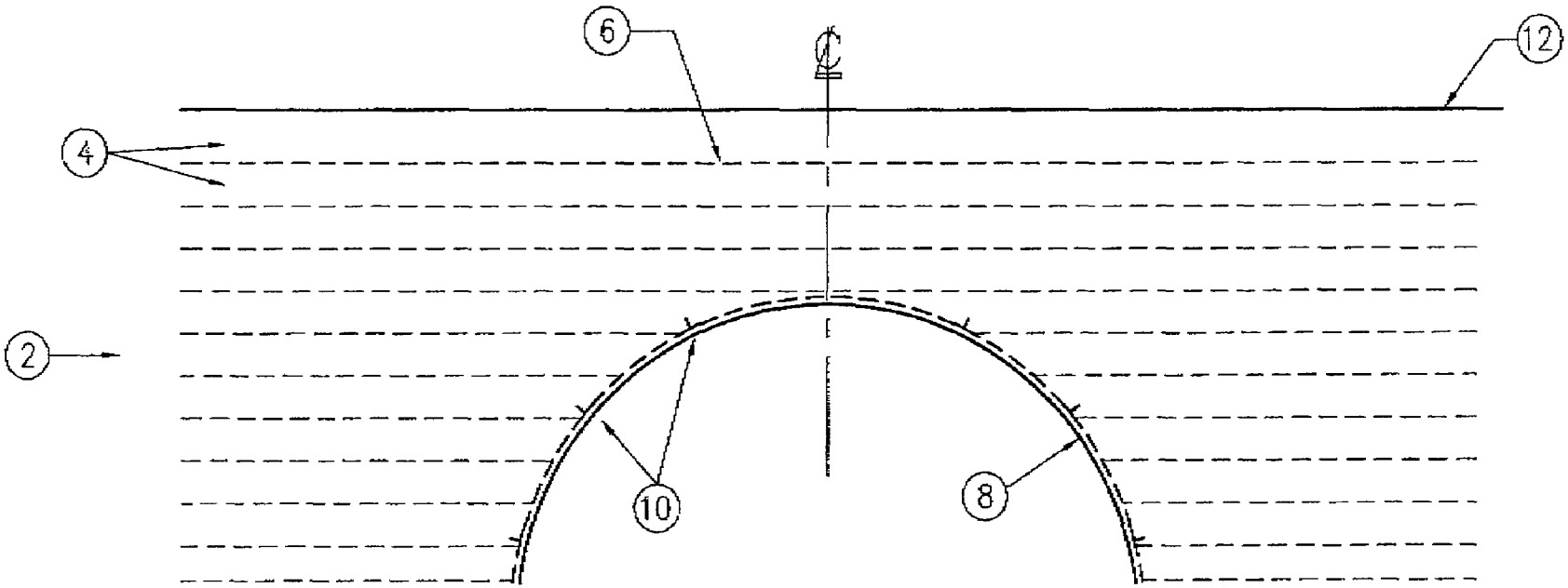
FIG. 1 illustrates a cross-section view of a compacted soil geosynthetic reinforced arch according to a first embodiment of the invention.

Referring to the drawings, FIG. 1 illustrates a cross-section view of a geosynthetic reinforced compacted soil arch structure according to a first embodiment of the invention. FIG. 1 specifically shows a reinforced soil arch 2 (typically positioned over a natural stream channel or installed as an underpass structure) consisting of alternating layers of compacted soil 4 and geosynthetic reinforcement 6 enveloping the exterior of an arch form 8 which rests on the ground or on a temporary elastic footing. The geosynthetic reinforcement can be woven geotextile, which is available commercially in the marketplace and is extremely strong and withstands environmental degradation. Spatially arranged on the top exterior of the arch form 8, typically structural metal plate, are a series of angle plates 10. These are affixed to the exterior of the arch form 8 by welding, bolting or some other convenient securing system. These angle plates 10 cooperate with the proximate portions of the alternating layers of compacted soil 4 and reinforcing geosynthetic material 6 to keep the steel arch form in contact with the reinforced soil arch 2 to act as an integral unit. The reinforced soil arch 2 supports a road grade 12 or other overpass structure at the top surface. The top surface 12 can be gravel or be paved. The selection of backfill, soil type, soil reinforcements, form type, shape and size, foundation type, soil reinforcement spacing, orientation, length and the like, are all based on specific site constraints dictated by the location where the reinforced soil arch is to be installed, and the loading requirements of the reinforced soil arch 2.

A unique and important feature of the reinforced soil arch according to the invention is the integration of the proximate regions of the alternating layers of compacted soil and reinforcement material with the basic arch form to provide a unitary load bearing structure. The series of angle plates 10 hold the proximate edges of the alternating layers of compacted soil 4 and geosynthetic material 6 against the exterior of arch form 8. This prevents shear and separation between the arch form and the overlying alternating layers of compacted soil and reinforcing geosynthetic material. As a consequence of this unique and inexpensive structure, the reinforced soil arch can accommodate the application of both static and dynamic loads without inducing internal separation between the interface of the layers of compacted soil and the reinforcing geosynthetic material and the arch form, thereby avoiding weakening the overall structure.

Figure 2:
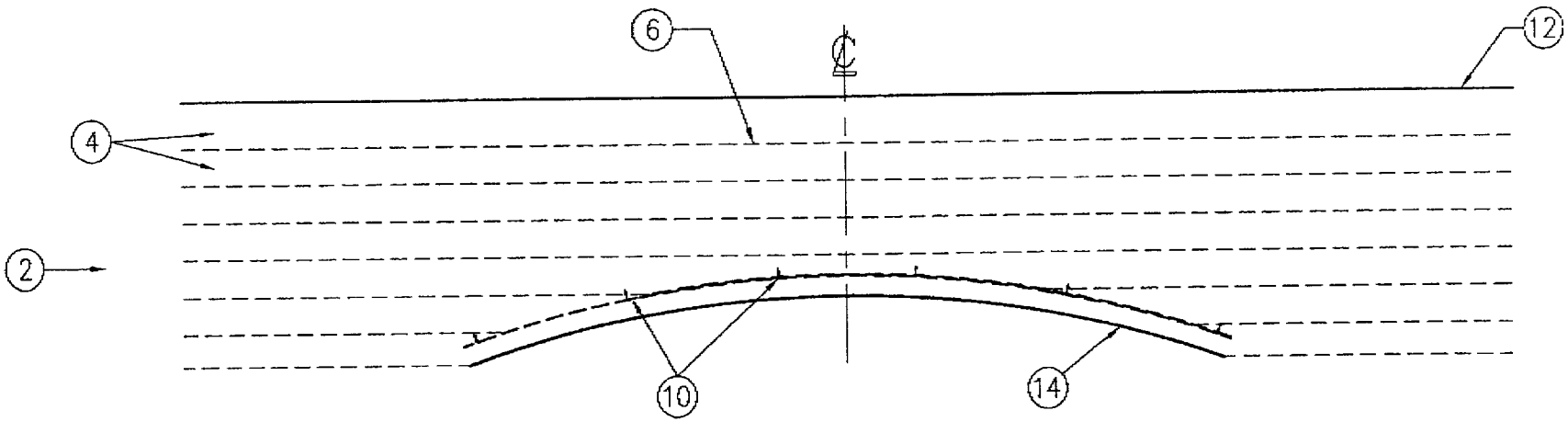
FIG. 2 illustrates a cross-section view of a shallow geosynthetic reinforced compacted soil arch according to a second embodiment of the invention.

FIG. 2 illustrates a cross-section view of a shallow geosynthetic reinforced compacted soil arch according to a second embodiment of the invention. As can be seen in FIG. 2, the reinforced soil arch 2 is similar in construction to the soil arch discussed previously in association with FIG. 1. The shallow soil arch comprises alternating layers of compacted soil 4 and geosynthetic reinforcement 6. The second embodiment shown in FIG. 2 represents what is termed a "shallow" arch form 14. Arch form 14 is roughly four to six times as wide as its height. This shallow arch form 14 is used in situations where a low profile is required or where there is insufficient elevation to accommodate a higher profile arch form as illustrated in FIG. 1. The top surface of the shallow arch form 14 has a series of angle plates 10 disposed along its curvature. These angle plates 10 cooperate with the proximate portions of the compacted soil layers 4 and reinforcing geosynthetic material 6 to create an arch form which acts as an integral unit.

Figure 3:
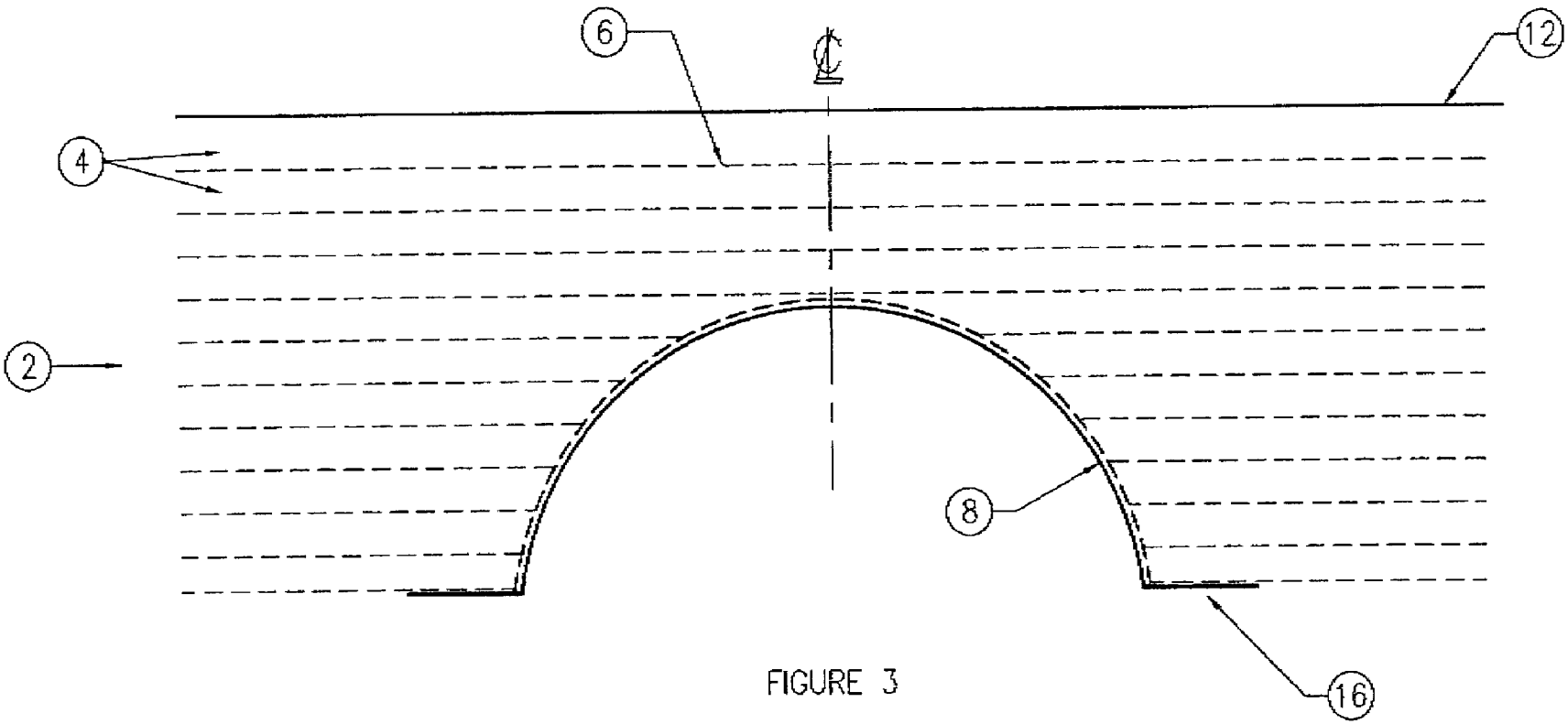
FIG. 3 illustrates a cross-section view of a geosynthetic reinforced compacted soil arch with base plate according to a third embodiment of the invention.

FIG. 3 illustrates a cross-section view of a geosynthetic reinforced compacted soil reinforced soil arch with base plates according to a third embodiment of the invention. The third embodiment illustrated in FIG. 3 represents a variation on the geosynthetic reinforced soil arch illustrated in FIG. 1. In FIG. 3, the angle plates are absent and their action is replaced by securing base plates 16 located and affixed at the base ends of the arch form 8. The pair of base plates 16, which can be bolted or welded to the respective base ends of the arch form 8, are used to keep the arch form 8 in contact with the proximate regions of the alternating layers of compacted soil 4 and geosynthetic reinforcement 6 in place against the arch form. This retards subsidence and shifting of the arch form 8 from the compacted soil and geosynthetic reinforcement. Thus the entire soil arch construction acts as an integral unit.

Figure 4:
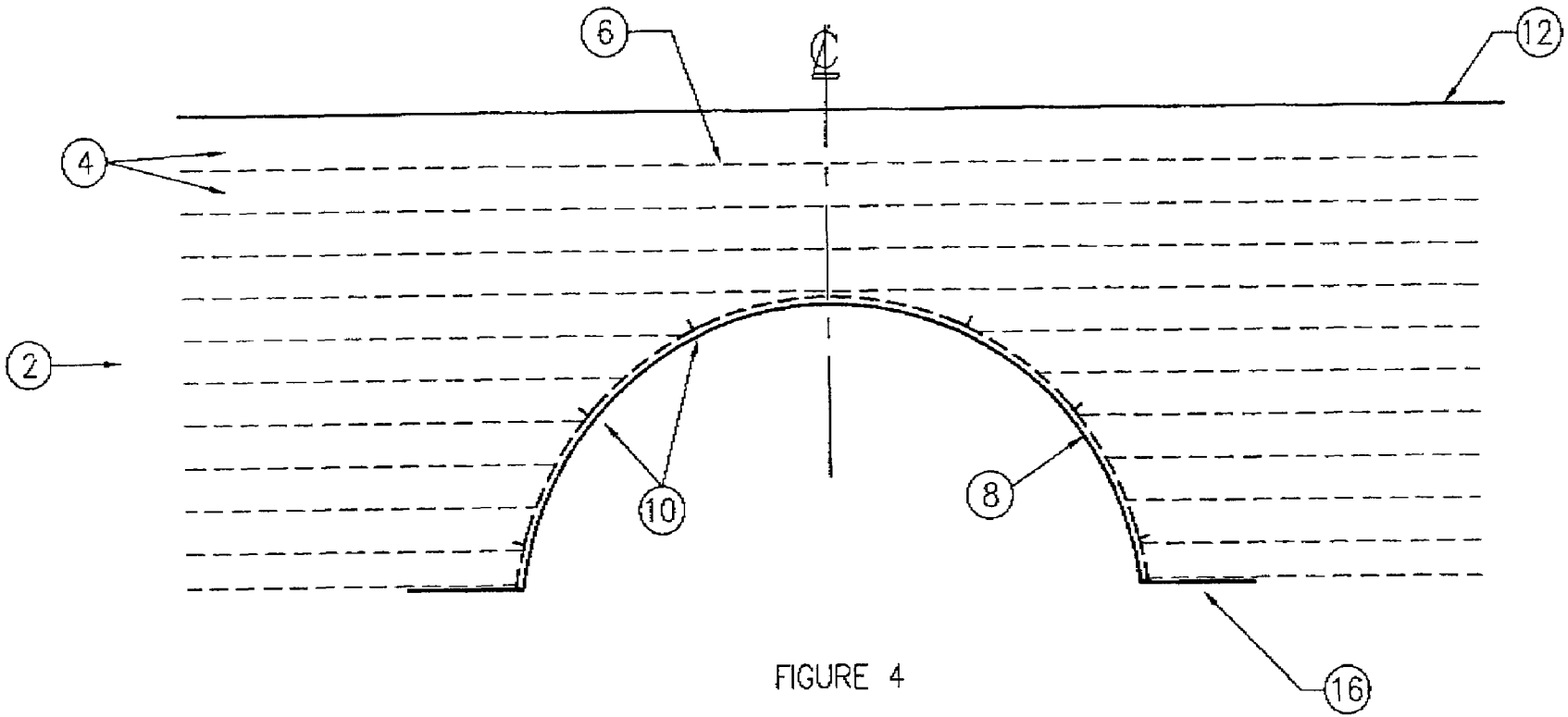
FIG. 4 illustrates a cross-section view of a geosynthetic reinforced compacted soil arch according to a fourth embodiment of the invention.

FIG. 4 illustrates a cross-section view of a compacted soil geosynthetic reinforced arch according to a fourth embodiment of the invention. As seen in FIG. 4, the soil arch construction includes a combination of angle plates 10 and base plates 16 which cooperate together to ensure that the arch form 8 and alternating layers of compacted soil 4 and geosynthetic reinforcement 6 do not separate. In some instances, when circumstances dictate, it may be advantageous to use both angle plates 10 and base plates 16 notwithstanding that the overall expense of the arch structure is slightly increased.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of constructing a self-supporting reinforced soil arch comprising:

(a) placing on the ground at the location where the soil arch is to be erected an archway form, an exterior surface of said archway form having disposed thereon a plurality of shear resisting devices;

(b) erecting over and adjacent to the archway form a series of alternating and interacting layers of compacted mineral soil and geosynthetic reinforcement material, the alternating layers of compacted mineral soil and geosynthetic reinforcement material interacting with the shear resisting devices on the exterior surface of the archway form to cause the reinforced soil arch to act as an integral unit in absorbing load forces placed on the soil arch.

2. A method as claimed in claim 1 wherein the shear resisting devices on the exterior surface of the archway form are a series of angle plates attached to the archway form.

3. A method as claimed in claim 1 wherein base plates are affixed to the respective bases of the archway form and retard the archway form from subsiding and separating from the alternating layers of compacted mineral soil and reinforcement material.

4. A method as claimed in claim 1 wherein the geosynthetic reinforcement material consists of geosynthetic, plastic, metal or wood material.

5. A method as claimed in claim 1 wherein the archway form is in the form of a semicircle or a shallow semicircle.

6. A method as claimed in claim 1 wherein the archway form is in the form of a reentrant arch, a vertical or horizontal ellipse, a pear shape, a box shape or a curved overpass/underpass.

7. A method as claimed in claim 1 wherein the geosynthetic reinforcement material comprises woven geotextile.

8. A self-standing reinforced soil arch comprising:

(a) an archway form which is placed on the location where the soil arch is to be erected;

(b) a combination of alternating and interacting layers of compacted mineral soil and geosynthetic reinforcement material placed over and adjacent to the archway form; and (c) a plurality of shear resisting devices secured to an exterior surface of the archway form and interacting with the combination of alternating layers of compacted mineral soil and geosynthetic reinforcement material to thereby cause the archway form and the combination of alternating layers of compacted mineral soil and geosynthetic reinforcement material to act as an integral unit when static or dynamic loads are placed on the reinforced soil arch.

9. A reinforced soil arch as claimed in claim 8 wherein the reinforcement material consists of geosynthetic, plastic, metal or wood.

10. A reinforced soil arch as claimed in claim 8 wherein respective base plates are secured to the bases of the archway form and retard the archway form from subsiding and separating from the alternating layers of compacted mineral soil and reinforcement material.

11. A reinforced soil arch as claimed in claim 8 wherein the geosynthetic reinforcement material is woven geotextile.

12. A reinforced soil arch as claimed in claim 8 wherein an archway form is constructed of corrugated metal, plastic, wood, concrete or a composite thereof.

13. A reinforced soil arch as claimed in claim 8 wherein the shear resisting devices are a series of angle plates welded or bolted to the exterior surface of the archway form.

14. A reinforced soil arch as claimed in claim 13 including base plates affixed to the respective bases of the archway form.

15. A reinforced soil arch as claimed in claim 8 wherein the archway form is in the form of a semicircle or a shallow semicircle, a reentrant arch, a vertical or horizontal ellipse, a pear shape, a box shape or a curved overpass/underpass.

16. A self-supporting reinforced soil arch comprising:

(a) an archway form which is placed on the location where the soil arch is to be erected;

(b) a combination of alternating and interacting layers of compacted mineral soil and geosynthetic reinforcement material placed over and adjacent to the archway form;

(c) a plurality of angle plates secured to an exterior surface of the archway form and interacting with the combination of alternating layers of compacted mineral soil and geosynthetic reinforcement material to thereby cause the archway form and the combination of alternating layers of compacted mineral soil and geosynthetic reinforcement material to act as an integral unit when static or dynamic loads are placed on the reinforced soil arch; and (d) base plates affixed to the respective bases of the archway form.

17. A reinforced soil arch comprising:

(a) an archway form;

(b) a plurality of alternating layers of compacted mineral soil and geosynthetic reinforcement material above and adjacent to the archway form;

(c) a plurality of stabilizing projections on an exterior surface of the archway form;

wherein the stabilizing projections interact with portions of the alternating layers of compacted mineral soil and geosynthetic reinforcement material proximate to the archway form so that the archway form and the alternating layers of compacted mineral soil and geosynthetic reinforcement material act as an integral unit when static or dynamic loads are placed on the reinforced soil arch.

18. A reinforced soil arch as defined in claim 17, wherein the plurality of stabilizing projections extend in a direction approximately normal to the surface of the archway form.

19. A reinforced soil arch as defined in claim 17, wherein the plurality of stabilizing projections comprise angle plates rigidly secured to the archway form.

20. A reinforced soil arch as defined in claim 17, wherein the plurality of stabilizing projections comprise planar members rigidly mounted to project generally perpendicularly to the archway form, and wherein spaces between the planar members are packed tightly with the alternating layers of compacted mineral soil and geosynthetic reinforcement material, such that shear motion of the soil relative to the archway form is prevented and the alternating layers of compacted mineral soil and geosynthetic reinforcement material act as an integral unit when static or dynamic loads are placed on the reinforced soil arch.

* * * * *